US007937898B2

(12) United States Patent
Quaranta

(10) Patent No.: US 7,937,898 B2
(45) Date of Patent: May 10, 2011

(54) RESIDENTIAL BUILDING COMPLEX

(75) Inventor: Paola Barbara Quaranta, Castano Primo Milano (IT)

(73) Assignee: Neolis S.r.l., Busto Arsizio (Varese) (IT)

( * ) Notice: Subject to any disclaimer, the term of this patent is extended or adjusted under 35 U.S.C. 154(b) by 332 days.

(21) Appl. No.: 11/883,202

(22) PCT Filed: Feb. 7, 2006

(86) PCT No.: PCT/EP2006/001202

§ 371 (c)(1),
(2), (4) Date: Jul. 27, 2007

(87) PCT Pub. No.: WO2006/087146

PCT Pub. Date: Aug. 24, 2006

(65) Prior Publication Data

US 2008/0034704 A1 Feb. 14, 2008

(30) Foreign Application Priority Data

Feb. 17, 2005 (IT) ..... MI2005A0240

(51) Int. Cl.
*E04B 1/00* (2006.01)

(52) U.S. Cl. ..... 52/169.1; 52/90.1; 52/234

(58) Field of Classification Search ..... 52/169.2, 52/169.3, 234, 90.1

See application file for complete search history.

(56) References Cited

U.S. PATENT DOCUMENTS

| | | | | | |
|---|---|---|---|---|---|
| 1,694,309 | A * | 12/1928 | Buckham | 52/176 |
| 2,449,681 | A * | 9/1948 | Wilson | 96/16 |
| 3,732,649 | A * | 5/1973 | Mehran | 52/169.3 |
| 3,996,709 | A * | 12/1976 | Coxe | 52/169.3 |
| 4,141,184 | A | 2/1979 | Vidal et al. | |
| 4,575,977 | A * | 3/1986 | Taylor | 52/169.3 |
| 4,597,238 | A * | 7/1986 | Vadala' | 52/606 |
| 4,679,363 | A * | 7/1987 | Adams | 52/169.3 |
| 5,254,246 | A * | 10/1993 | Rivelli et al. | 210/195.4 |
| 6,470,633 | B2 * | 10/2002 | Showen | 52/169.1 |
| 6,688,052 | B1 | 2/2004 | Flanders | |
| 6,758,169 | B2 * | 7/2004 | Suzuki et al. | 123/3 |

FOREIGN PATENT DOCUMENTS

| | | |
|---|---|---|
| DE | 200 04 078 | 9/2000 |
| WO | WO 2004/090327 | 10/2004 |

OTHER PUBLICATIONS

United States Army Corps of Engineers, Model Conservation Easement Document, Revised Aug. 2003 (see attachment).*

Meccan River Outfitters and Lodge—Canoe Trips and Camping Facilities. Retrieved from the Internet <URL http://web.archive.org/web/20010203155100/http://www.mecanriveroutfitters.com/camping.html > Website Page dated Feb. 3, 2001.*

International Search Report, May 24, 2006.

* cited by examiner

*Primary Examiner* — Brian E Glessner
*Assistant Examiner* — Adam Barlow
(74) *Attorney, Agent, or Firm* — Hedman & Costigan, P.C.; James V. Costigan

(57) ABSTRACT

The present invention relates to a building complex (100) of the type containing eight construction elements (2) for residential use, situated at a suitable relative distance so as not to create visible interference with each other. Each construction element (2) for living purposes has a square plan base (3), at least an internal patio element (4), and at least one entrance facade (5). Each construction element (2) for residential use comprises a series of carrying building structures (6) situated along the perimeter of each construction element (2) for residential use.

9 Claims, 4 Drawing Sheets

RESIDENTIAL BUILDING COMPLEX

The present invention relates to a residential building complex.

Modern living conditions are inducing more and more people to look for a healthy life in a pleasant environment.

Problems relating to unhealthy living, both in terms of physical illnesses and existential discomfort, are becoming increasingly more evident.

Proposals are growing in all product spheres and fields of science, which are oriented towards re-establishing equilibrium between body/mind/spirit.

The awareness is also developing that many pathologies in rapid growth are associated with disastrous energy imbalances caused by human beings.

The physical damage caused by electromagnetism is now widely known.

Another widelyspread problem is so-called indoor pollution i.e. the presence, in the air of closed environments, of physical, chemical and biological contaminants, not present naturally in high-quality outdoor air. The main sources of contaminants are specifically the construction materials (in some of which the presence of radon has actually been demonstrated, such as, for example, in cement, tuffs, pozzolans, granites), paints, murals, glues and any other material introduced into the residence without considering the toxic components.

Among these radon should be mentioned. Radon is a radioactive noble gas produced by the deterioration of uranium and present in the Earth's crust. In the open air, it rapidly dilutes, whereas in closed environments it accumulates and, in some cases, can reach such concentration levels as to represent a health risk. It is sufficient to think that radon is currently considered the second cause of death due to lung cancer, after smoking. In order to reach the inside of buildings, radon is released from the ground (for example from construction materials or from water) and passes through openings, even microscopic, of floors and walls in general. The interaction between the building and site, the use of particular construction materials, the types of building constructions are therefore the most significant elements for evaluating the influence of radon on the quality of the air inside residences and buildings in general.

A variety of unhealthy living conditions often cause various degrees of disturbances, above all during rest hours when the body is sleeping and therefore lowers its immune defenses to prepare for regeneration. Studies carried out on sleep confirm that the quality of sleep, both Rem and non-Rem, is necessary for good health. Energy regeneration takes place already in the first phase of sleep; subsequently, during non-Rem sleep, there is a high production of the growth hormone which is vital for physical health; finally, in Rem sleep, the blood flow towards the brain increases and this is useful for mental health. Very often, however, various kinds of pathologies (for example: insomnia, migraine, anxiety, confusion) arise, mainly due to invisible electromagnetic bombardment.

Buildings constructed according to widespread construction procedures are certainly not capable of solving the problems described above. Interventions can sometimes be made to correct, as much as possible, various serious situations such as, for example providing protection for electric plants, but this has a limited efficacy. Corrective solutions are often only possible by means of radical interventions which, when possible, are extremely onerous with respect to the benefit obtained.

In view of what is specified above, the necessity is evident of availing of a building complex, such as that according to the present invention, which allows the problems of the known art to be solved.

An objective of the present invention is to provide a building complex suitable for conferring maximum health conditions to the building, by providing an environment based on the human perception of the surrounding energy level.

A further objective of the present invention is therefore to provide a building complex which eliminates or in any case significantly reduces electromagnetic and sound pollution.

Another objective of the present invention is to provide a building complex which tends to eliminate or in any case reduce indoor pollution.

Finally, an additional objective of the present invention is to provide a building complex which tends to eliminate or in any case reduce radon pollution.

These and other objectives are achieved by the building complex according to the present invention which has the characteristics of the enclosed claim 1.

Other characteristics of the invention are indicated in the subsequent claims.

Further characteristics and advantages of the present invention will appear more evident from the present description, provided for illustrative and non-limiting purposes, with reference to the enclosed drawings, in which.

Figure 1:
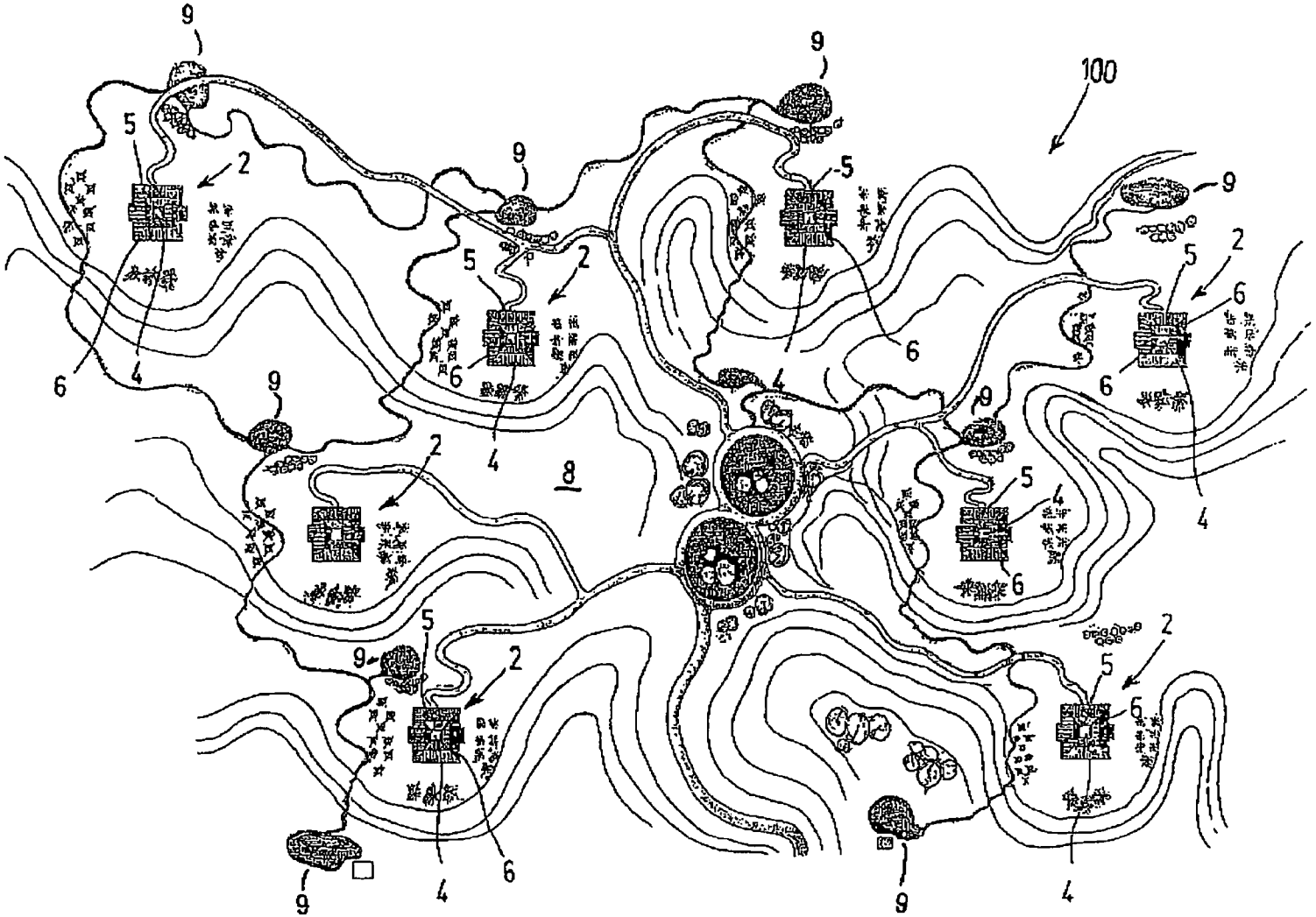
FIG. 1 shows a schematic view from above of a building complex according to the present invention.
Figure 2:
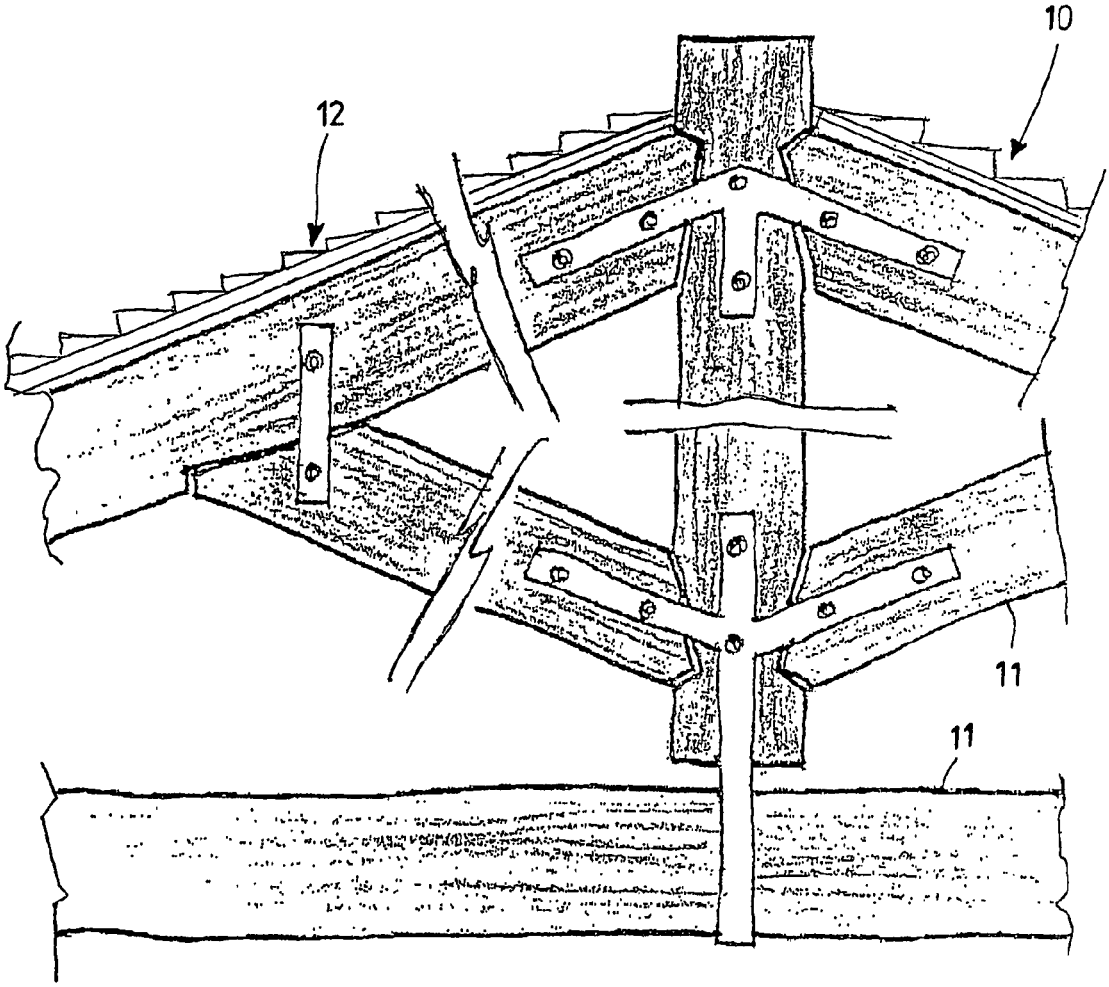
FIG. 2 shows a schematic front view from above of a preferred embodiment of the carrying structure of the cover of a construction element for residential use according to the present invention.
Figure 3A:
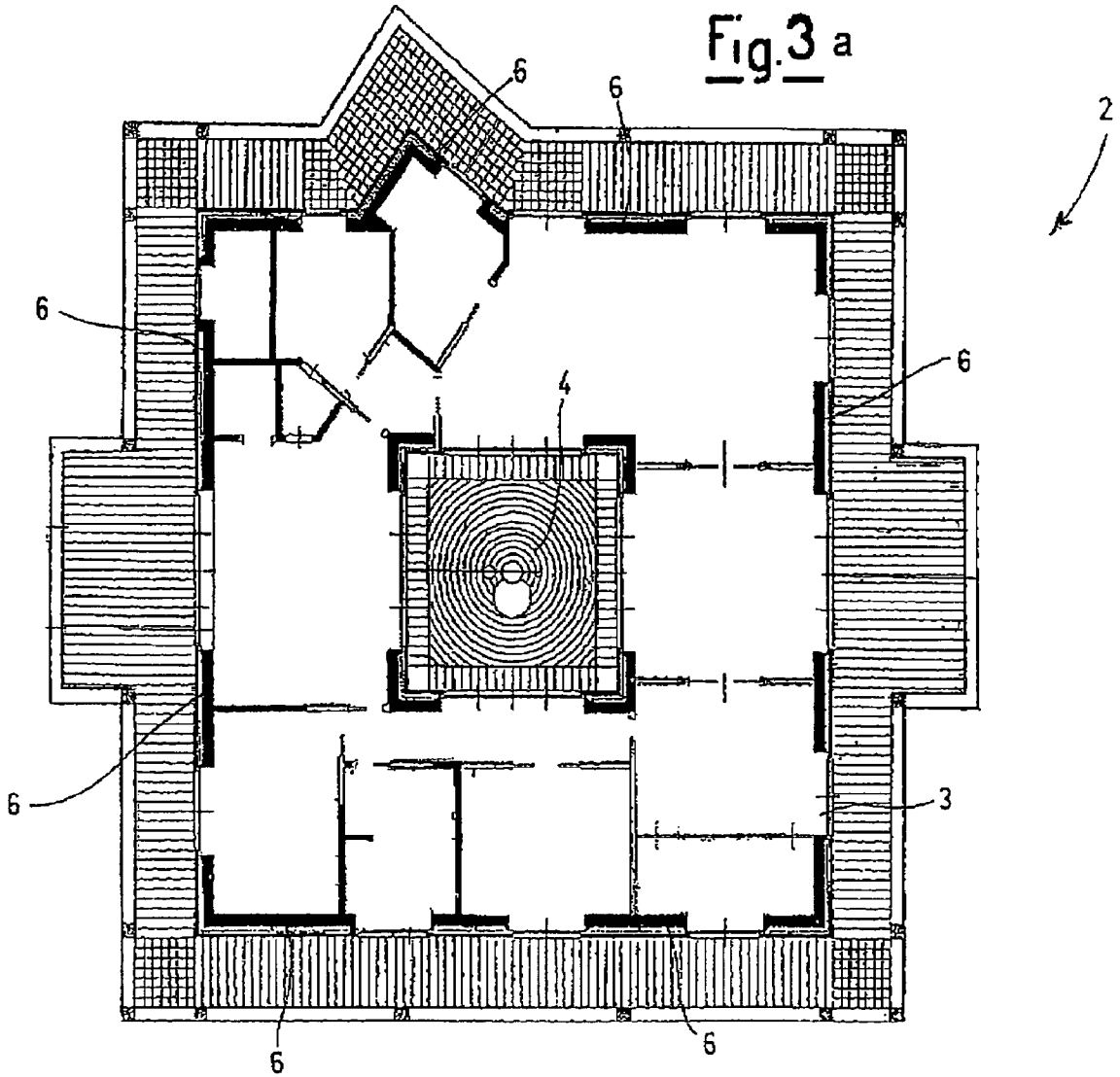
FIGS. 3*a* and 3*b* show schematic plan views of preferred embodiments of a construction element for residential use according to the present invention.
Figure 3B:
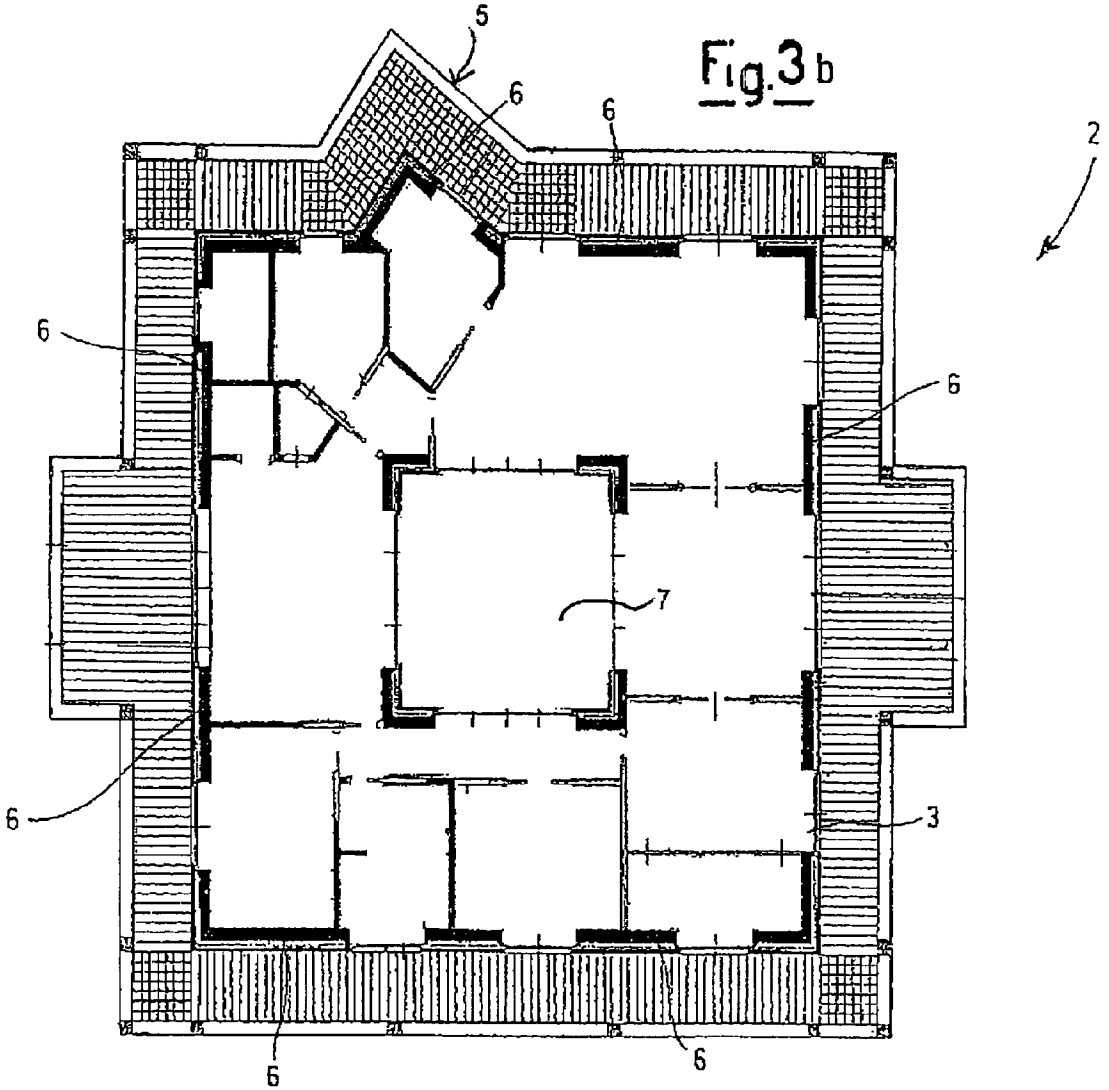

With reference to FIG. 1, this shows a building complex according to the present invention.

The building complex, according to the present invention, indicated as a whole with the numerical reference 100, is of the type containing eight construction elements 2 for residential use, situated at a relative distance which is such as to not allow visible interference with each other.

Each construction element 2 for residential use has a square plan base 3, at least one internal patio element 4, optionally substituted by an internal mezzanine floor 7.

Each construction element 2 for residential use comprises a series of carrying building structures 6, preferably, but not exclusively, situated along the perimeter of the construction element 2 for residential use. According to an aspect of the present invention, the entrance facade 5 of each construction element 2 is advantageously oriented in a north-west direction within the range of 292.5° to 337.5°, or a south-east direction within the range of 112.5° to 157.5°.

It has been surprisingly found that the exposure of the construction elements 2 for residential use, following a similar orientation, favours good health and prosperity, based on the human perception of the surrounding energy level of the people living there.

The complex 100 also has a territorial extension 8 within the range of 20,000 $m^2$ and 50,000 $m^2$ and each construction element for residential use 2 is built on top of portions of area free of underground water or faults.

This prevents the construction from standing on geopathogenic sources identified according to the studies of the physicist Hartman. Furthermore, the construction element 2 thus planned, prevents people from living, inside the residence, on top of one of the greatest radon conductors, i.e. water.

According to another advantageous aspect of the present invention, the territorial extension 8, free of telephone poles and electroducts, is selected in an area without rubbish dumps or industrial plants.

Each carrying building structure 6 comprises a wall made exclusively of structural alveolar bricks, thus allowing a perfect thermal-acoustic insulation to be obtained for each construction element 2, from the outside.

According to the present invention, it is therefore possible to produce carrying elements which do not necessitate, as normally envisaged by the known art, walls made of reinforced concrete.

The absence of reinforced concrete in the carrying building structure 6 allows a better transpiration of the environment, consequently increasing the quality of the air inside each construction element for residential use 2, thus allowing a real and concrete building aimed at eliminating electromagnetic pollution, indoor pollution and radon pollution.

The sole absence of the ironwork of the concrete reinforcement, according to the known art, eliminates the continuous passage of current therein, which raises the degree of electromagnetic pollution.

Each carrying building structure 6 is also finished with mortars or plasters selected from natural materials. In other words, the mortars for the walling and for the plasters comprise materials compatible with the environment, such as, for example, natural lime and/or gravel and/or sand and/or earth and/or clay and materials containing radon are excluded.

According to an alternative aspect of the present invention, each carrying building structure 6 can comprise portions made of wood and/or natural stone.

As far as the cover 10 of each construction element 2 for residential use, is concerned, its carrying structure 11 consists of wooden trusses.

The wooden trusses are visibly exposed directly inside each construction element 2.

In other words, each construction element 2 for residential use does not comprise a ceiling, as envisaged by the known art.

The covering surface 12 of each construction element 2 for residential use is selected from bricks and/or stone slabs.

The internal subdivision of each construction element 2 for residential use is at least partially obtained by means of partitioning, not shown, consisting of moveable panels, possibly also packable.

The flooring of each construction element 2 for residential use, on the other hand, is selected from wood and/or natural stones and/or tatamis.

According to an advantageous aspect of the present invention, the treatment and painting of the wooden parts forming the carrying structure 11 of the covering element, the flooring and/or portions of wall or partitioning are effected with natural paints or products.

In order to reduce the environmental impact of each element 2 to the minimum, it should be noted that its construction, without basement rooms, is effected by building it directly on the ground, i.e. reducing earth-moving excavations and fillings, as much as possible.

This tends to eliminate or in any case reduce the passage of radon as much as possible.

Furthermore, each construction element 2 for residential use has a limited height suitable for being perfectly integrated with the surroundings. For this reason, each construction element 2 for residential use is built on a single floor. In order to rationalize the space, it is optionally possible to envisage an internal mezzanine floor which, in this case, substitutes the patio.

In order to prevent electric pollution generated by electric currents, and at the same time providing the comfort of modern household appliances, the electric plant of each construction element 2 for residential use, is completely protected and follows specific courses suitable for excluding the major rest points of people, such as, for example, the whole perimeter of beds, including headboards, and dining tables.

The same attention is paid for the water supply and discharge plant and for the heating plant of each construction element 2 for residential use.

The centralization of the plants is situated outside, away from each construction element 2 for residential use.

In order to improve the internal healthiness of the environments, there is a centralized aspiration plant for the collection of powder which considerably reduces the presence of mites.

In order to guarantee minimum environmental impact, each building complex 100 also comprises at least one water sanification and/or recovery and/or purification and/or recycling plant 9.

Once the recovered and/or sanified and/or purified and/or recycled water has been treated, it will be subsequently reused for various functions such as plant irrigation and/or the feeding of any possible internal ponds and/or internal fountains and/or for household use.

It has been decided to base the construction of these building complexes on the traditional Chinese teachings of Xuan Kong Feng Shui, integrating and combining them in a new and original manner, with what is offered by modern technology. A building complex is thus obtained in which it is possible to enjoy the comfort of a modern home, immersed in and surrounded by nature, all with the maximum respect for energy and environmental equilibrium, in a new refined and harmonious living reality.

According to the present invention, all human beings, when inserted in an environment in which the surrounding positive energy conditions are in equilibrium with their own subtle reality, can progressively reestablish a state of well-being and the renewed equilibrium easily facilitates the evolutional process of the mind/body/spirit, with a consequent improvement in the quality of life (for example: they sleep better; the harmful effects of food excess is attenuated).

The present invention is described for illustrative but non-limiting purposes, according to its preferred embodiments but variations and/or modifications can obviously be applied by experts in the field, all included within the relative protection scope, as defined by the enclosed claims.

The invention claimed is:

1. A residential building complex (100) of the type containing eight construction elements (2) for residential use, situated at a relative distance which is such as to not allow visible interference with each other, each construction element (2) for residential use has a square plan base (3) and at least one entrance facade (5) characterized in that each construction element (2) for residential use comprises a series of carrying building structures (6), situated along the perimeter of said construction element (2) for residential use, and a shielded electric plant to prevent electric pollution generated by electric current and in that said entrance facade (5) is oriented in a north-west direction within the range of 292.5° to 337.5°, or in a south-east direction within the range of 112.5° to 157°; said complex (100) comprising a territorial extension (8), within the range of 20,000 square meters to 50,000 square meters, where the territorial extension is free of telephone poles and electroducts wherein each construction element (2) for residential use comprises at least one internal patio element (4) within the construction element.

2. The building complex (100) according to claim 1, characterized in that each carrying building structure (6) comprises a wall exclusively made of alveolar bricks for the thermal-acoustic insulation of said construction element (2).

3. The building complex (100) according to claim 1, characterized in that each construction element (2) for residential use comprises at least one internal mezzanine floor.

4. The building complex (100) according to claim 1, characterized in that each carrying building structure (6) comprises portions made of wood and/or natural stone.

5. The building complex (100) according to claim 1, characterized in that each construction element (2) for residential use comprises a cover (10) equipped with a carrying structure (11) and a covering surface (12).

6. The building complex (100) according to claim 5, characterized in that said carrying structure (11) consists of wooden trusses.

7. The building complex (100) according to claim 5, characterized in that the covering surface (12) is selected from bricks and/or stone slabs.

8. The building complex (100) according to claim 1, characterized in that it comprises at least one water recovery and/or sanification and/or purification and/or recycling plant.

9. The building complex (100) according to claim 1, characterized in that the shielded electric plant follows routes that exclude the whole perimeter of beds and dining tables.

* * * * *